United States Patent [19]

Poggiali

[11] 4,008,804

[45] Feb. 22, 1977

[54] BATHTUB CONTAINER AND METHOD

[75] Inventor: Lewis D. Poggiali, Owosso, Mich.

[73] Assignee: Olinkraft, Inc., West Monroe, La.

[22] Filed: Oct. 9, 1975

[21] Appl. No.: 621,101

Related U.S. Application Data

[62] Division of Ser. No. 428,800, Dec. 27, 1973, Pat. No. 3,957,158.

[52] U.S. Cl. ..... 206/320; 206/326; 206/413; 206/583; 229/14 C

[51] Int. Cl.² ..... B65D 85/30; B65D 85/64

[58] Field of Search ..... 206/320, 321, 326, 521, 206/403, 407, 413, 414, 415, 416, 454, 455; 229/14 C, 23 R

[56] References Cited

UNITED STATES PATENTS

| | | | |
|---|---|---|---|
| 1,989,053 | 1/1935 | Hills et al. | 206/407 |
| 2,474,657 | 6/1949 | Corson | 206/407 |
| 2,853,185 | 9/1958 | Rollie | 206/407 |
| 3,193,095 | 7/1965 | Martino et al. | 229/14 C |
| 3,464,367 | 9/1969 | Latter | 229/14 C |
| 3,616,986 | 11/1971 | Wolfe | 206/320 |
| 3,757,935 | 9/1973 | Coons et al. | 206/320 |
| 3,845,859 | 11/1974 | Dornbush | 206/320 |
| 3,853,219 | 12/1974 | Castine, Jr. | 206/454 |

*Primary Examiner*—William Price
*Assistant Examiner*—Bruce H. Bernstein
*Attorney, Agent, or Firm*—O'Brien & Marks

[57] ABSTRACT

An improved package for completely enclosing a bathtub within the package wherein the bathtub is carried by a pair of support members fixed to the insides of the end caps of the invention. Each end cap has formed thereon at least one cushion member which is hingedly attached to the end cap and also has fixedly attached to the end cap the beforementioned support member. Also disclosed is a method for supporting a bathtub on its opposite top end edges within the new and improved package so that the bathtub is suspended on the support member fixed to the end caps thereby providing improved protection from shipping and storage damage.

2 Claims, 10 Drawing Figures

BATHTUB CONTAINER AND METHOD

CROSS REFERENCE TO RELATED APPLICATION

This is a divisional application of pending Application Ser. No. 428,800 filed Dec. 27, 1973, now U.S. Pat. No. 3,957,158.

BACKGROUND OF THE INVENTION

This invention relates generally to paperboard containers and more particularly relates to a new and improved bathtub shipping package which has improved features that allow the bathtub to be suspended within the package for improved resistance to damage occurring during shipping and storage of similar packaged bathtubs on top of each other.

In the handling of residential bathtubs formed of pressed steel, special problems are encountered in preparing the bathtubs for shipping and storage due to the large heavy size of the bathtubs as well as their finished surfaces which must be free from damage when installed in the ultimate user's home. It is known in prior art bathtub containers to form the container by manufacturing a wooden crate and placing the bathtub therein for shipment to the consumer. Such containers while protecting the bathtub during the trip to the consumer, often increase the handling problems of the tub due to the extra weight encountered with the use of the heavy wooden frame used to surround the bathtub.

It is also known to reduce the weight of the heavy wooden crates by the use of a combination wood and paperboard without destroying the effectiveness of the protection afforded by the container. Such efforts utilized a combination of wooden end caps in conjunction with paperboard top and bottom panels which were banded to the wooden end caps at the end of the package. This type of package, while serving its ultimate purpose, still required fabrication of heavy wooden end caps which added greatly to the cost of the entire package.

Attempts have been made to utilize an all paperboard shipping package which eliminated the wooden slats of reinforcement hereinbefore mentioned but obtained the cushioning effect around the bathtub edges at the expense of having to use many cardboard padded pieces placed at various critical positions within the package for cushioning that portion of the bathtub during shipment. Other attempts were made to achieve the necessary structural stability by using an elongated wooden rod at the lower rear feet of the tub in combination with a partial wooden end frame and a paperboard overlaying tube in combination with previously tried cardboard cushions. This type of design, like other attempted designs using wood framing, was expensive to manufacture and did not provide the ultimate in a desired shipping container from the consumer's standpoint.

The prior art efforts at forming and perfecting a shipping package having a tube member and a pair of end caps for use in packaging a bathtub or the like are typified by the following patents:

| U.S. Patent No. | Patentee | Issue Date |
|---|---|---|
| 1,054,655 | L. J. Ives | February 25, 1913 |
| 2,651,448 | J. L. Dusseault | September 8, 1953 |
| 3,099,351 | D. F. Coffey, Jr. | July 30, 1963 |

-continued

| U.S. Patent No. | Patentee | Issue Date |
|---|---|---|
| 3,181,768 | T. W. Flynn et al | May 4, 1965 |
| 3,194,395 | D. M. Weaver et al | July 13, 1965 |
| 3,289,825 | R. K. Smith | December 6, 1966 |
| 3,386,567 | R. K. Smith | June 4, 1968 |
| 3,486,612 | R. J. Kivell | December 30, 1969 |
| 3,487,914 | D. M. Weaver et al | January 6, 1970 |
| 3,521,744 | R. K. Smith | July 28, 1970 |
| 3,616,986 | R. E. Wolfe et al | November 2, 1971 |
| 3,680,688 | R. K. Smith | August 1, 1972 |
| 3,757,935 | E. A. Coons et al | September 11, 1973 |
| 3,773,171 | R. N. Edsall | November 20, 1973 |

One problem typically occurring in the handling of bathtubs such as those packaged in the bathtub container is the condition described as "pop off" in the porcelain of the tub. As happens on many occasions, the bathtub package may be accidentally dropped from a forklift truck that happens to be moving the package or from a dolly with the bottom feet of the tub or a bottom portion of the tub receiving a severe blow as that portion hits the ground resulting in pieces of porcelain from the tub popping off or loosening so that the appearance of the tub is impaired.

SUMMARY OF THE INVENTION

In order to overcome the general problems inherent in the prior art bathtub structures and also to minimize the condition of "popping off" the subject invention provides an improved bathtub package which completely encloses a bathtub within the package so that the bathtub is carried by a pair of end supports which are fixed to the insides of the end caps. The support members that are fixed to the end caps thereby carry the entire weight of the bathtub within the package whenever the bathtub package is positioned right side up so that the critical bottom area of the bathtub "floats" inside the package and is not exposed to heavy shocks from mishandling that may damage the porcelain on the bottom portion of the bathtub.

Accordingly it is an object of the invention to provide a new and improved bathtub package for completely enclosing a bathtub so that critical portions of the bathtub are cushioned and/or protected from shock damage.

Another object of the invention is to provide a new and improved bathtub package which has improved stacking strength and allows several bathtub packages to be stacked on top of each other without the weight of the stack affecting the bathtubs in the lower portion of the stack.

Yet another object of the invention is to provide a new and novel bathtub package which utilizes new and novel end caps that have cushion end support members hingedly attached thereto for cushioning and supporting the ends of the package and the bathtub.

Yet another object of the invention is to provide a new and novel two-piece end cap for a wrap-around bathtub package having novel supporting members positioned thereon for supporting the bathtub and floating it within the bathtub package.

Still yet another object of the invention is to provide a new and novel production blank for an end cap for use in a wrap-around bathtub container package that comprises a plurality of roll up cushion members formed around the sides thereof and also contains means for locking a mating support member to the end cap structure.

Yet another object of the invention is to provide a new and improved method for supporting a bathtub at the opposite top edges of the bathtub for shipment and for storage within the shipping container so that the bathtub is carried by the structure of the end caps and floats within the bathtub package.

These and other objects and advantages of the invention will become apparent after a review of the complete description of the preferred embodiment and from a study of the drawings of the application.

DESCRIPTION OF THE PREFERRED EMBODIMENT

Figure 1:
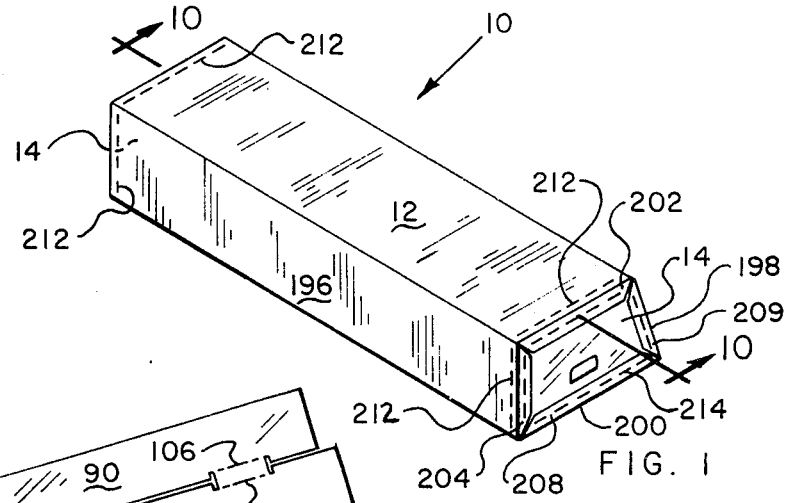
FIG. 1 is a perspective view of the subject bathtub container of the invention.
Figure 2:
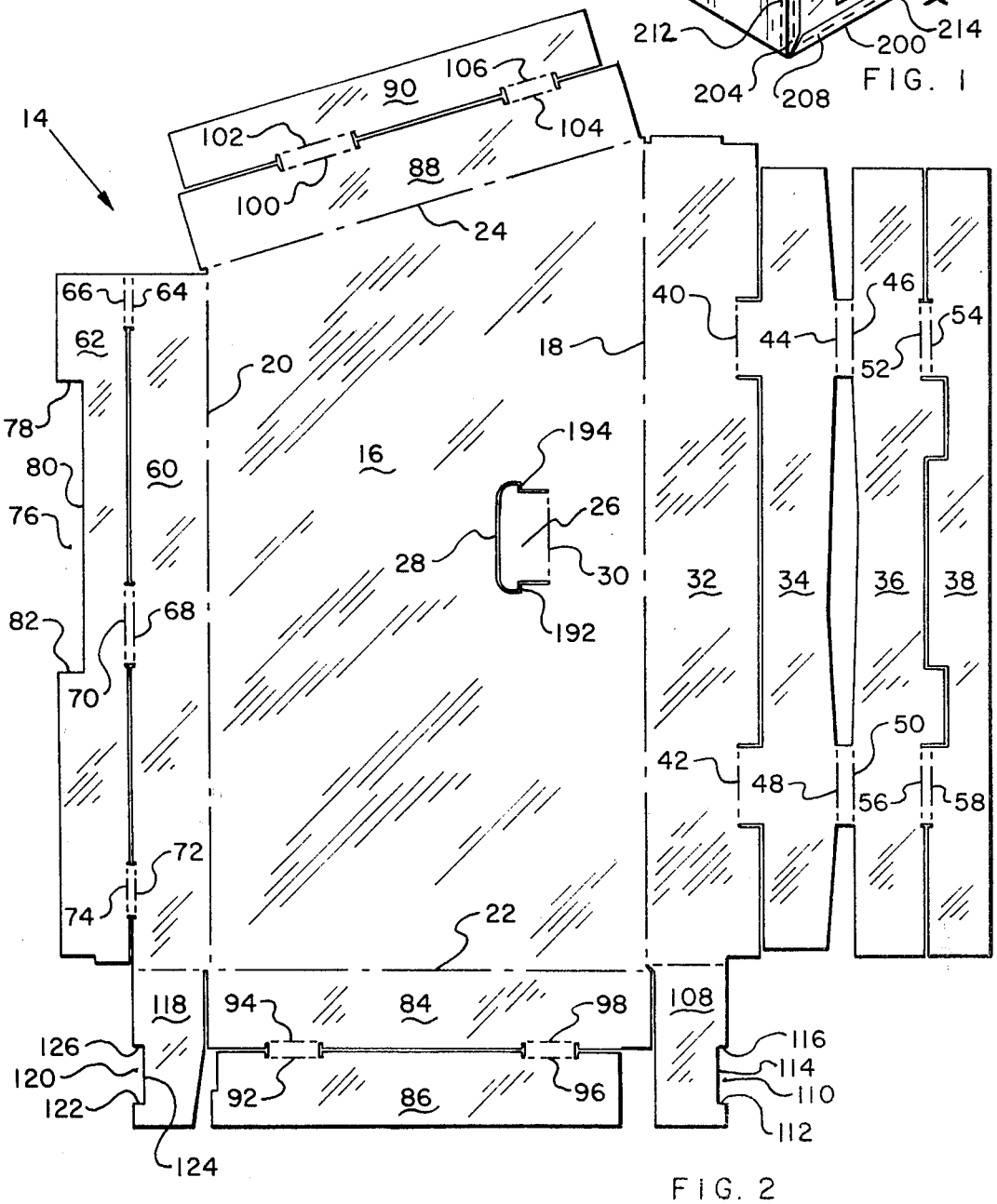
FIG. 2 is a plan view of the production blank of one end cap of the bathtub package shown in FIG. 1.

Referring now to the drawings in general and in particular to FIG. 1 of the drawing there is shown the bathtub package of the subject invention generally by the numeral 10 which comprises a wrap-around tube member 12 and a pair of end caps 14 positioned within each end of the tube member 12. The tube member 12 may be formed as a four panel wrap-around member having overlapping flaps for forming a manufactured joint to completely enclose the tube member. An example of this type of tube member is shown in FIG. 2 of U.S. Pat. No. 3,757,935, issued September 11, 1973 to Everett A. Coons et al. Variations of this tube member may be utilized with the subject new and novel end cap configuration within the spirit and scope of the invention.

Referring now to FIG. 2 of the drawings there is shown a production blank of a portion of the new and novel end cap configuration which comprises a generally four-sided planar member 16 which may be in the form of a trapezoid or a rectangle and which has a top side 18, a bottom side 20, a front side 22 and a rear side 24 formed by means of scorelines as is known in the art. Formed in the central portion of the planar member 16 is a locking tab 26 formed by means of the curved die cut 28 in combination with the scoreline 30. The function of the locking tab 26 will be described more fully hereinafter when referring to the support member portion of the subject invention. In the preferred embodiment, the planar member 16 has formed on each side thereof a cushion member which is hingedly attached to the planar member as shown in FIG. 2 of the drawings. The top side 18 of the planar member has a quadruple thickness cushion member formed thereon by means of the elongated tabs 32, 34, 36 and 38 which are hingedly attached to each other by means of the scorelines 40, 42, 44, 46, 48, 50, 52, 54, 56 and 58. Whenever it is desirous to have a triple thickness cushion member formed on the top side 18 of the planar member, then the elongated tab 38 would be eliminated and in a similar manner whenever it is desirous to have a double thickness cushion member, the elongated tab 36 and the elongated tab 38 would be eliminated. In a like member if it is desirous to have only a single thickness cushion member, the elongated tab 34 as well as the elongated tabs 36 and 38 would be eliminated.

In the preferred embodiment, the bottom side 20 of the planar member has formed thereon a double thickness cushion member in the form of the elongated tabs 60 and 62 which are hingedly attached together by means of the scorelines 64, 66, 68, 70, 72 and 74. The elongated tab 62 has formed thereon a recess 76 formed by means of the die cuts 78, 80 and 82 for the purpose which will be more fully described hereinafter when referring to the support member portion of the subject invention.

The front side 22 as well as the rear side 24 of the preferred embodiment also have formed thereon cushion members in the forms of elongated flaps 84, 86, 88 and 90 which are hingedly attached to each other by means of the scorelines 92, 94, 96, 98, 100, 102, 104 and 106. The elongated tab 32 has formed on one end thereof an interlocking tab 108 which has formed thereon an interlocking recess 110 formed by means of the die cuts 112, 114 and 116. In a similar manner the elongated tab 60 has formed on one end thereof an interlocking tab 118 which has formed thereon an interlocking recess 120 in the form of the die cuts 122, 124 and 126. The interlocking recess 110 is designed to be positioned between the flaps 84 and 86 onto the hinge formed by means of the scorelines 96 and 98. In a similar manner the interlocking recess 120 is designed to be positioned between the flaps 84 and 86 and to lock onto the hinge formed by means of the scorelines 92 and 94 adding torsional stability to the end cap structure. It is within the spirit and scope of the invention that other interlocking tabs could be formed on the other cushion members to interlock the various adjacent cushion members together.

Figure 3:
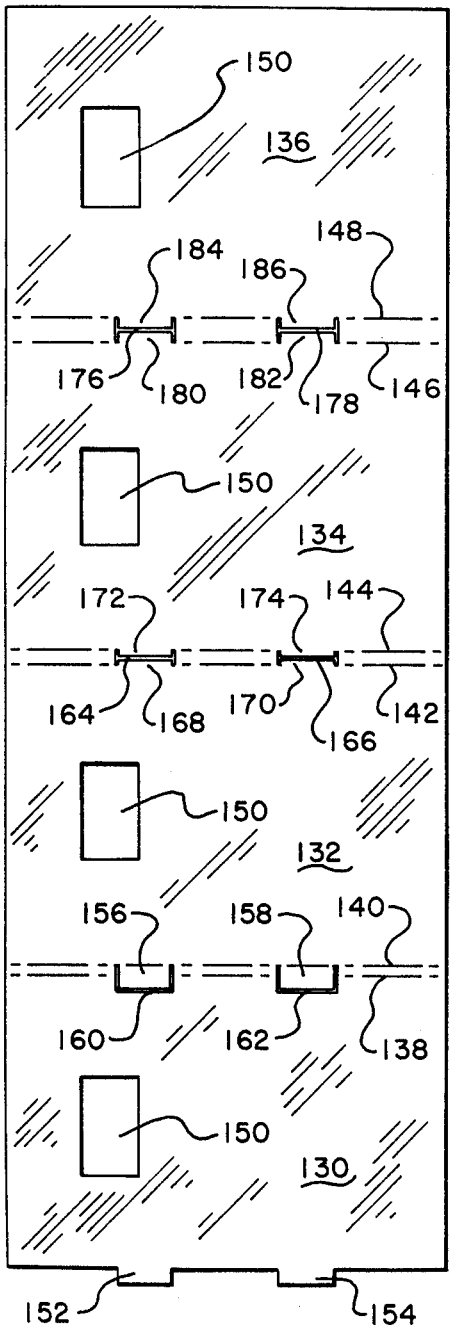
FIG. 3 is a plan view of the production blank of the support member portion of the end cap for the bathtub package.
Figure 4:
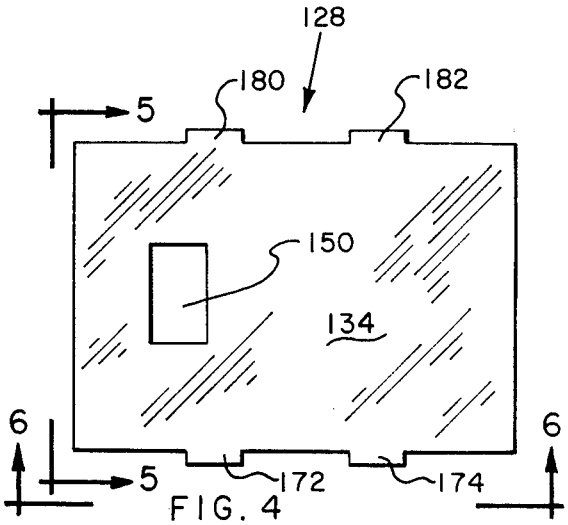
FIG. 4 is a plan view of the support member shown in FIG. 3 rolled up and formed into the condition that it will ultimately have before being positioned on the end cap.
Figure 5:
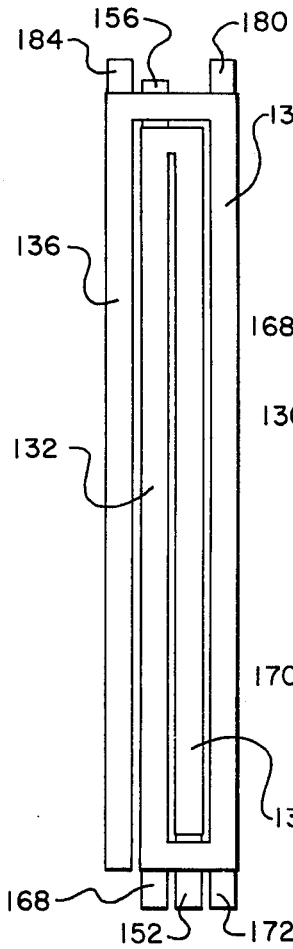
FIG. 5 is a view, taken along line 5—5 of FIG. 4 showing the support member rolled up and locked in place by the plurality of tabs formed thereon.

Referring now to FIGS. 3–5 of the drawings there is shown, generally by the numeral 128 in FIG. 4, the support member portion of the subject invention. The support member 128 is formed by a plurality of panels 130, 132, 134 and 136 which are hingedly attached to each other as shown in FIG. 3 of the drawing by means of the scorelines 138, 140, 142, 144, 146 and 148. Formed in each of the panels 130, 132, 134 and 136 is an opening 150 which functions in combination with the locking tab 26 on the planar member 16 as will be described more fully hereinafter.

By referring now to FIGS. 3 and 5 there will be described how the support member 128 is formed as a four-thickness support for the subject bathtub package. The panel 130 has formed on one end thereof a pair of locking tabs 152 abd 154 while the panel 132 has formed thereon a pair of locking tabs 156 and 158 by means of the die cuts 160 and 162. A pair of I-shaped die cuts 164 and 166 between the scorelines 142 and 144 form a pair of locking tabs 168 and 170 on the panel 132 and in addition form a pair of locking tabs 172 on the panel 134. In a similar manner an I-shaped die cut 176 and 178 positioned between the parallel scorelines 146 and 148 form a pair of locking tabs 180 and 182 for the panel 134 and also a pair of locking tabs 184 and 186 for the panel 136. By referring to FIGS. 5 and 6 it will be seen how the respective panels are folded into juxtaposition so that the panel 136 is in juxtaposition to panel 132 which is in turn in juxtaposition to panel 130 which is in turn in juxtaposition to panel 134 with the various locking tabs positioned as shown in the drawing. In this manner the support member 128 is firmly held together so that it forms a four-thickness support member for supporting the bathtub as will be more fully described hereinafter. It is within the spirit and scope of the invention that the support member may be formed with less than four thicknesses and may also be formed with more than four thicknesses as may be desired by the purchaser of the package.

Figure 7:
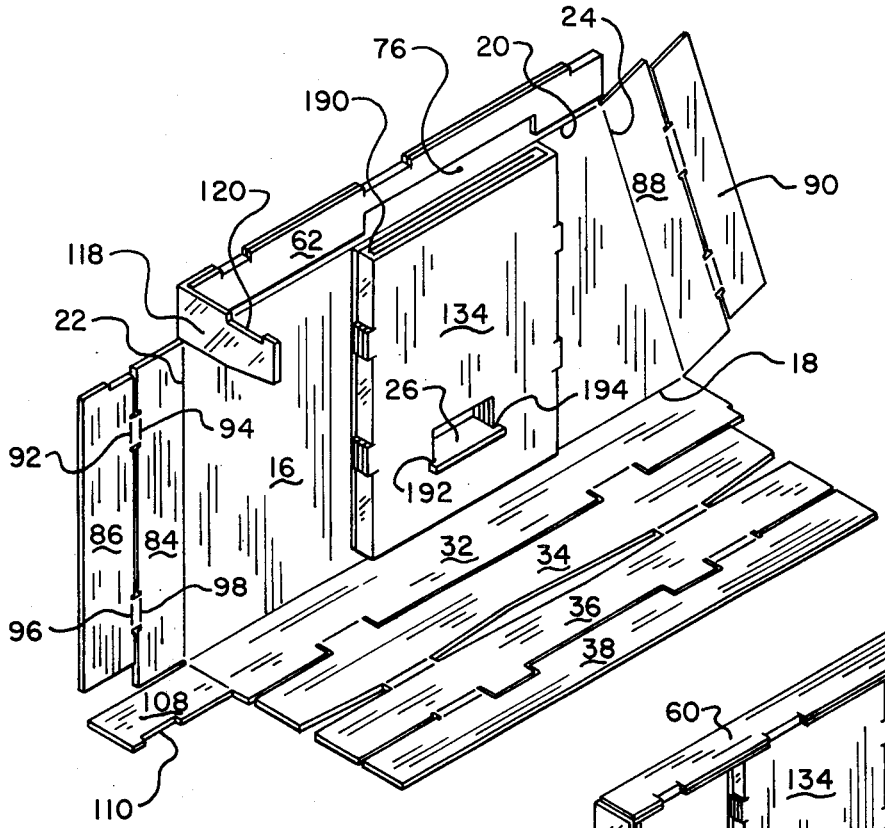
FIG. 7 is a perspective view showing the end cap structure of the subject invention and also showing the support member of the subject invention positioned on the end cap prior to the cushioning members of the end cap being rolled up and positioned in place.
Figure 8:
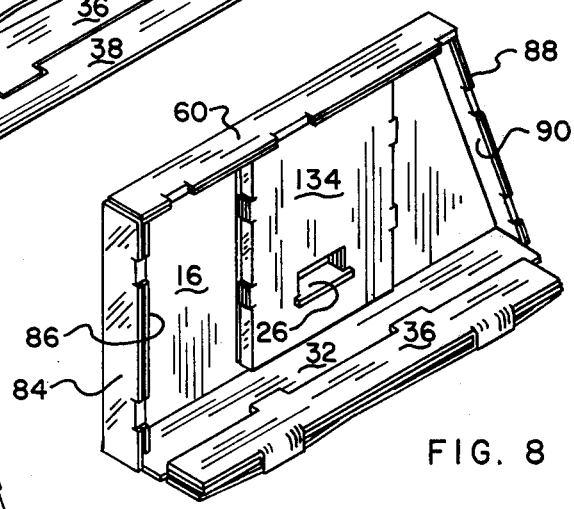
FIG. 8 is a perspective view similar to FIG. 7 showing a portion of the cushioning members rolled up and positioned with the cushioning member that cushions the top of the bathtub structure being partially rolled up.
Figure 9:
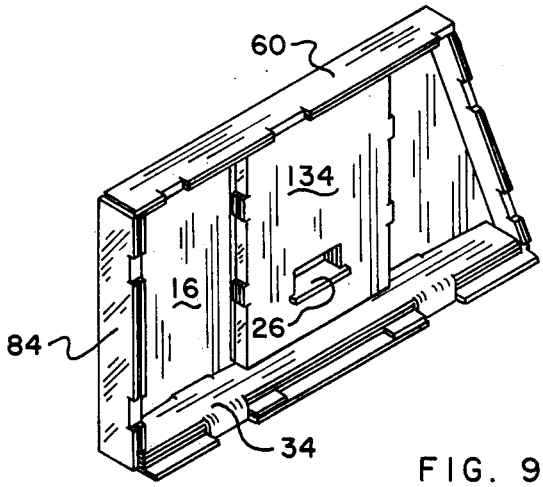
FIG. 9 is a perspective view similar to FIGS. 7 and 8 showing the completed end cap structure with the support member in position and all of the cushioning members rolled up and positioned as they would be after the bathtub has been positioned therein and the tube member wrapped around the end caps.

Referring now to the drawing FIGS. 7–9 there will be shown the relationship between the planar member 16 and the support member 128 and how the end cap 14 is finally formed as it would be whenever it is positioned inside the tube member 12. For purposes of clarity, the bathtub has not been shown in the sequence of drawings FIGS. 7–9 and the sequence is not necessarily meant to illustrate the only manner of assembly of the two components into an end cap structure since obviously there are many variations of the assembly procedure which could form the completed end pack. The tabs 38, 36 and 34 are rolled up onto each other as shown in the sequence and as also taught in the beforementioned U.s. Pat. No. 3,757,935 and are positioned as shown in FIG. 9 of the drawing with the tab 36 in final juxtaposition with the tab 32 and with the tab 34 facing upwardly. In a similar manner the tab 62 is rolled over into juxtaposition with the tab 60 as shown in FIG. 7 of the drawing and is then further positioned so that both tabs are generally horizontal as shown in FIG. 8 of the drawing to form the cushion member for the bottom of the bathtub. In forming the cushion member for the front of the bathtub the tabs 118 and 108 are positioned between tabs 84 and 86 so that their respective locking recesses 120 and 110 are positioned to lock on the hinge formed by the scorelines 92, 94, 96 and 98. The cushion member for the rear portion of the bathtub is formed by rolling the tab 90 into juxtaposition with the tab 88 as shown in FIG. 8 of the drawings and positioning them generally perpendicular with the planar member 16.

Figure 6:
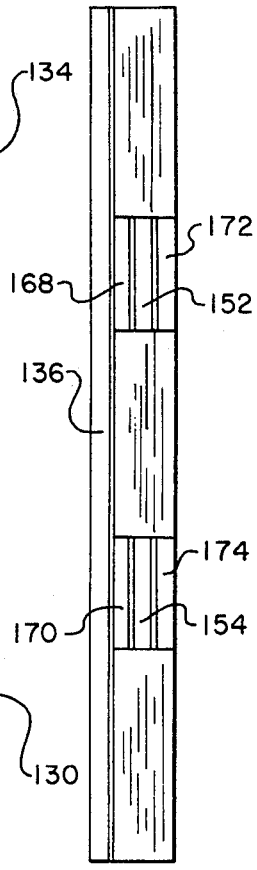
FIG. 6 is a view, taken along line 6—6 of FIG. 4, showing the support member of FIG. 4.

As beforementioned the support member 128 has been folded into the configuration shown in the drawing FIGS. 4, 5 and 6 and is positioned on the planar member 16 in such a manner that the panel 136 is positioned against the planar member 16 with the panel 134 being exposed on the interior portion of the end cap. This is shown in FIG. 7 of the drawing and the locking tab 26 of the planar member 16 is positioned through the openings 150 so that its edges 192 and 194 may be bent into position shown in FIG. 7 in contact with the panel 134 thereby locking the locking tab 26 to the support member. The top edge 190 of the support member is positioned within the recess 76 formed on the tab 62 whenever that tab is positioned as shown in FIG. 8 or 9 of the drawings. From this it can be seen that the lower portion of the support member is rigidly held to the planar member 16 by means of the locking tab 26 while the upper portion of the support member is rigidly held to the upper portion of the planar member by means of the locking effect achieved by the use of the recess 76.

Figure 10:
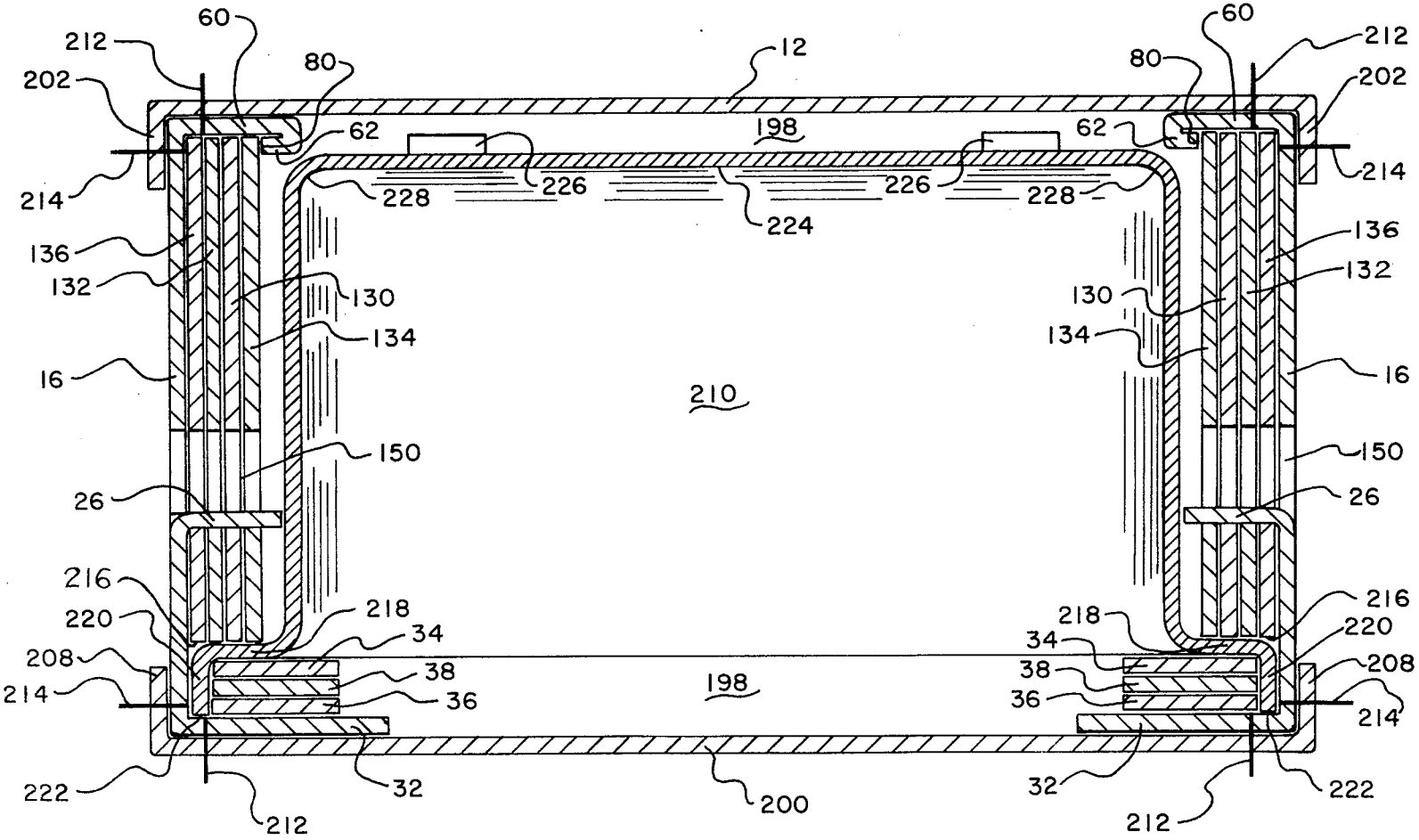
FIG. 10 is a sectional view, taken along line 10—10 of FIG. 1, showing the end caps with their cushioning members and the support members in their final position and showing the bathtub "floating" within the package.

Referring now to FIGS. 1 and 10 of the drawing there will be now be described in more detail how the bathtub is finally positioned within the shipping package and how the bathtub structure is carried by the support members 128 so that the tub is free to "float" within the package to eliminate "popping off" of the porcelain of the tub. In FIG. 1 as well as in FIG. 10 it should be noted that the package is shown with the bathtub 210 being positioned upside down in the package as would be the final position after the bathtub is packaged in one manner of assembly. The tube member 10 may be formed with a bottom panel 12 hingedly attached to a front panel 196 which is hingedly attached to a top panel 200 which is in turn hingedly attached to a rear panel 198. Each of these panels may have tabs formed on the ends thereof which are ultimately used to lock the end caps 14 to the ends of the tube member 10. For example the bottom panel 12 has formed on the ends thereof the tabs 202 while the front panel 196 has formed on the ends thereof the tabs 204. In a similar manner the top panel 200 has formed on the ends thereof the tabs 208 and the rear panel 198 has formed on the ends thereof the tabs 209.

When the bathtub 210 is finally positioned within the bathtub package and the various end caps with their supporting members are positioned as will be described more fully hereinafter, a plurality of staples 212 may be used to fasten the panels 12, 196, 198 and 200 to the end caps 14 while a plurality of staples 214 may be used to fasten the tabs 202, 204, 208 and 209 to the end caps from the ends of the package. The staples 212 and 214 are shown in FIG. 10 of the drawing as heavy solid lines to indicate their approximate location in relation to the end cap structure.

As beforementioned when the support members 128 are positioned against the end caps 14, they are locked in place by means of the locking tab 26 at one end thereof and also are locked in place at the other end thereof by means of the die cut surface 80 forming the notch 76 in the end cap structure. As a result the upper portion 216 of the support member 128 is positioned against the portion 218 of the tub 210 while the cushion members 34, 38 and 36 are positioned between the tub portion 218 and the cushion member 32. In addition the upturned lip 220 on the tub 210 is positioned between the planar member 16 and the cushion members 34, 38 and 36 and also the cushion member 32 which protects its upper edge 222 from damage to the porcelain in that area of the tub.

By inverting FIG. 10 of the drawing the package with the tub contained therein can be seen in the right side up or the position in which the tub may be shipped and also may be stored. When in this position it can be seen that the tub 210 is carried by the support members 128 with the tub portion 218 bearing on the upper portion 216 of the support members. In this manner the bottom of the bathtub 224, the tub legs 226 and the corners 228 of the bottom of the bathtub are actually floating within the package and do not come in contact with the bottom panel 12 of the package. In this manner whenever the package may be accidentally dropped the shock incurred from the dropping will be absorbed by the support members 128 and will not pass to the bathtub bottom 224 through the legs 226 or the corners 228 thereby minimizing "popping off" of the porcelain in this area of the bathtub.

It can also be seen in FIG. 10 of the drawing that whenever similar types of packages are stacked on top of each other, the support members 128 will serve to help carry the weight of the packages stacked on top of the package shown.

In practicing the method of the subject invention a four-sided end cap is provided which has at least one cushion member formed on the top portion of the end cap and a support member is provided and positioned on each end cap member and is fixedly attached thereto. The opposite top edges of the bathtub are positioned between the cushion member and the support member and the end caps are fastened within the wrap-around tube member forming the package to thereby suspend the bathtub on the support member and within the shipping package container thereby protecting it from shipping and storage damage.

From the above it can be seen that there has been provided an improved package which completely encloses a bathtub within the package and which provides improved protection for critical portions of the bathtub that may be damaged due to accidental dropping of the package. The improved package also provides improved stacking capabilities which allows stacking of the package on top of other similarly constructed packages without damage to the lower packages. The package of the subject invention may be constructed of paperboard such as corrugated paperboard or may be formed of other materials within the spirit and scope of the invention.

From the foregoing it should be obvious that the subject package has accomplished all of the objects and advantages of the invention; however, it should also be apparent that many changes can be made in the package and the arrangement of the parts of the package and the method of the invention without departing from the spirit and scope of the invention.

Having described the invention, I claim:

1. A two-piece paperboard end cap for a wrap-around bathtub package, the combination comprising a. a four sided planar member having top and bottom edges and front and rear side edges, b. a plurality of cushion members, one for each of said edges, with each cushion member formed with at least a pair of roll-up members that are perpendicularly disposed to said planar member at its corresponding edge, c. a support member position in juxtaposition to said planar member and between said cushion members, d. the cushion member at said top edge having a recess in one of said roll-up members receiving an end of said support member whereby the end of said support member is disposed adjacent the other of said roll-up members, and e. fixing means operatively connecting said planar member and said support member whereby said support member is fixedly attached to said planar member.

2. A two-piece end cap recited in claim 1 wherein said fixing means includes hinged locking tab means on said planar member and a tab receiving opening on said support member whereby said hinged locking tab means is received in said opening for locking said support member to said planar member.

* * * * *

UNITED STATES PATENT OFFICE

CERTIFICATE OF CORRECTION

PATENT NO. : 4,008,804

DATED : February 22, 1977

INVENTOR(S) : Lewis D. Poggiali

It is certified that error appears in the above-identified patent and that said Letters Patent are hereby corrected as shown below:

Column 4, Line 30, delete "member" and insert in place thereof -- manner --.

Column 5, Line 14, delete "abd" and insert in place thereof -- and --.

Column 6, Line 25, following the word will delete the word "be".

Signed and Sealed this

Thirty-first Day of May 1977

[SEAL]

*Attest:*

RUTH C. MASON
*Attesting Officer*

C. MARSHALL DANN
*Commissioner of Patents and Trademarks*